US009335019B2

(12) United States Patent
Dreβler et al.

(10) Patent No.: US 9,335,019 B2
(45) Date of Patent: May 10, 2016

(54) HEADLIGHT FOR VEHICLES

(71) Applicant: Hella KGaA Hueck & Co., Lippstadt (DE)

(72) Inventors: Björn Dreβler, Menden (DE); Matthias Ehm, Lippstadt (DE); Daniel Süsselbeck, Lippstadt (DE)

(73) Assignee: HELLA KGAA HUECK & CO. (DE)

( * ) Notice: Subject to any disclaimer, the term of this patent is extended or adjusted under 35 U.S.C. 154(b) by 35 days.

(21) Appl. No.: 14/305,436

(22) Filed: Jun. 16, 2014

(65) Prior Publication Data

US 2014/0376249 A1 Dec. 25, 2014

(30) Foreign Application Priority Data

Jun. 24, 2013 (DE) ..... 10 2013 106 569

(51) Int. Cl.
*F21S 8/10* (2006.01)

(52) U.S. Cl.
CPC ..... *F21S 48/145* (2013.01); *F21S 48/115* (2013.01); *F21S 48/1258* (2013.01); *F21S 48/1784* (2013.01); *F21S 48/1794* (2013.01)

(58) Field of Classification Search
CPC ... F21S 48/115; F21S 48/145; F21S 48/1258; F21S 48/1784; F21S 48/1794
See application file for complete search history.

(56) References Cited

FOREIGN PATENT DOCUMENTS

| | | | |
|---|---|---|---|
| DE | 3241713 | A1 | 5/1984 |
| DE | 3523029 | A1 | 1/1986 |
| DE | 10044392 | A1 | 3/2002 |
| DE | 102008036192 | A1 | 2/2010 |
| DE | 102010045435 | A1 | 3/2012 |
| EP | 0935728 | B1 | 9/1998 |

*Primary Examiner* — Mary Ellen Bowman
(74) *Attorney, Agent, or Firm* — Husch Blackwell LLP

(57) ABSTRACT

A headlight for vehicles, having a reflector, a light source unit which is functionally assigned to the reflector, a lens placed in front of the light source unit in the primary beam direction, and an aperture device arranged between the light source unit and the lens. The aperture device is positioned in a focal point region of the lens and has an aperture edge which runs perpendicular to the optical axis for the purpose of generating a light/dark boundary for a prespecified light distribution. The light source unit has a plurality of light sources separated spatially from each other, such that light can be emitted from an illumination surface. The aperture edge transitions into a correction edge from a central region of the aperture device towards opposite ends of the same. The correction edge runs in such a manner that an optical lens aberration resulting from the light source unit being constructed as an illumination surface is compensated.

10 Claims, 2 Drawing Sheets

HEADLIGHT FOR VEHICLES

CROSS REFERENCE

This application claims priority to German Patent Application No. 10 2013 106569.4, filed Jun. 24, 2013, which is hereby incorporated by reference.

FIELD OF THE INVENTION

The invention relates to a headlight for vehicles, having a reflector, having a light source unit which is functionally assigned to the reflector, having a lens placed in front of the light source unit in the primary beam direction, having an aperture device arranged between the light source unit and the lens, said aperture device being positioned in a focal point region of the lens and having an aperture edge which runs perpendicular to the optical axis for the purpose of generating a light/dark boundary for a prespecified light distribution.

BACKGROUND

A headlight for vehicles is known from EP 0 935 728 B1, which works according to the projection principle. It has a reflector, a light source unit, a lens, and an aperture device arranged between the light source unit and the lens. The light source unit consists of a gas discharge lamp which is arranged in an internal focal spot of the ellipsoidal reflector. It can be considered a point-shaped light source. The aperture device comprises an aperture shaft which is arranged perpendicularly to an optical axis of the headlight. The aperture shaft has multiple aperture edges running in the longitudinal direction, which can be moved into an upper, light-active position by means of rotation of the aperture shaft. The aperture shaft is positioned in a focal point of the lens, such that the aperture edge can be projected on the road as a light/dark boundary of the corresponding light distribution. The various different aperture edges have different contours, such that it is possible to generate a low beam light distribution, city- or foul-weather light distribution, or a highway light distribution, by way of example. Headlights using point-shaped light sources have proven successful. However, if the light source unit has a plurality of light sources which are spaced from each other, and therefore implement an emission of light from an illumination surface, the problem arises that there are optical aberrations resulting from a field of curvature of the lens. The contour set by the aperture edge cannot be precisely projected on the road.

SUMMARY OF THE INVENTION

Therefore, the problem addressed by the present invention is that of implementing a headlight which works according to the projection principle, in such a manner that, when a planar light source unit is used, a light distribution determined by an aperture edge is precisely projected to create a light distribution.

To solve this problem, the invention is characterized in that the light source unit has a plurality of light sources separated spatially from each other, such that light can be emitted from an illumination surface, and in that the aperture edge transitions into a correction edge from a central region of the aperture device towards opposite ends of the same, said correction edge running in such a manner that an optical lens aberration resulting from the light source unit being constructed as an illumination surface is compensated.

According to the invention, an aperture edge of the aperture device has a correction edge on opposite end regions, and this correction edge corrects optical aberrations of the lens resulting from a planar light source unit. The optical aberrations result from a physical field of curvature and/or curved focal plane of the lens, occurring in the aperture device. The correction edge prevents rays of light—particularly those arriving at the aperture device diagonally—from being emitted if they would arrive above the prespecified light/dark boundary of the corresponding light distribution.

According to one preferred embodiment of the invention, the correction edge runs according to a projection scale of the lens and/or a size of the light source surface and/or the prespecified light distribution. If the light source surface has a larger design, by way of example, then the correction edge must rise or fall more radically from a central region of the aperture edge. The correction edge is adapted to the arrangement of the light source of a light source unit in such a manner that the contour of the aperture edge responds to the desired projection by the lens, for the purpose of generating a prespecified light distribution. The aperture edge modified in this manner would not lead to a proper projection if a point-shaped light source were used.

According to one preferred embodiment of the invention, the lens is designed as a plano-convex or concavo-convex lens. A curved focal plane of the lens results, wherein the apex of the curvature is arranged on a side which faces the light source. The correction edge rises towards the ends of the aperture device, such that rays of light—particularly those arriving at the aperture device diagonally—are shadowed, such that they cannot contribute to generating the prespecified light distribution. Otherwise, these diagonal light rays would travel above the prespecified light/dark boundary into opposite lateral regions of the light distribution.

According to one implementation of the invention, the lens is designed as a biconcave lens, wherein the correction edge falls vertically toward the ends of the aperture edge. In this way, the optical aberrations of the lens are compensated, the same resulting from the fact that the curved focal plane of the lens has an apex on a side facing the lens.

According to one preferred embodiment of the invention, the aperture device has an aperture shaft with a plurality of aperture edges having different contours, such that different light distributions can be generated by means of moving the aperture shaft. Because the same lens and the same light source unit are always used to generate the different light distribution, the correction edge runs in the same direction for all aperture edges, proceeding from a transverse central plane of the aperture shaft. The correction edge either falls or rises toward the ends. In both cases, the correction edge runs continuously such that the difficulty of manufacturing the same is low.

According to one further embodiment of the invention, the aperture device can consist of a stationary aperture plate and a rotating aperture plate, wherein the rotating aperture plate can be rotated at least partially into a position covering the stationary aperture plate, in such a manner that the aperture edge of the rotating aperture plate is active, for the purpose of generating a different light distribution. Both the stationary and the rotating aperture plates can have a corresponding correction edge in the end regions. As a result, the configuration ensures a simple adaptation of the headlight to a light source unit with a luminous field.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 3:
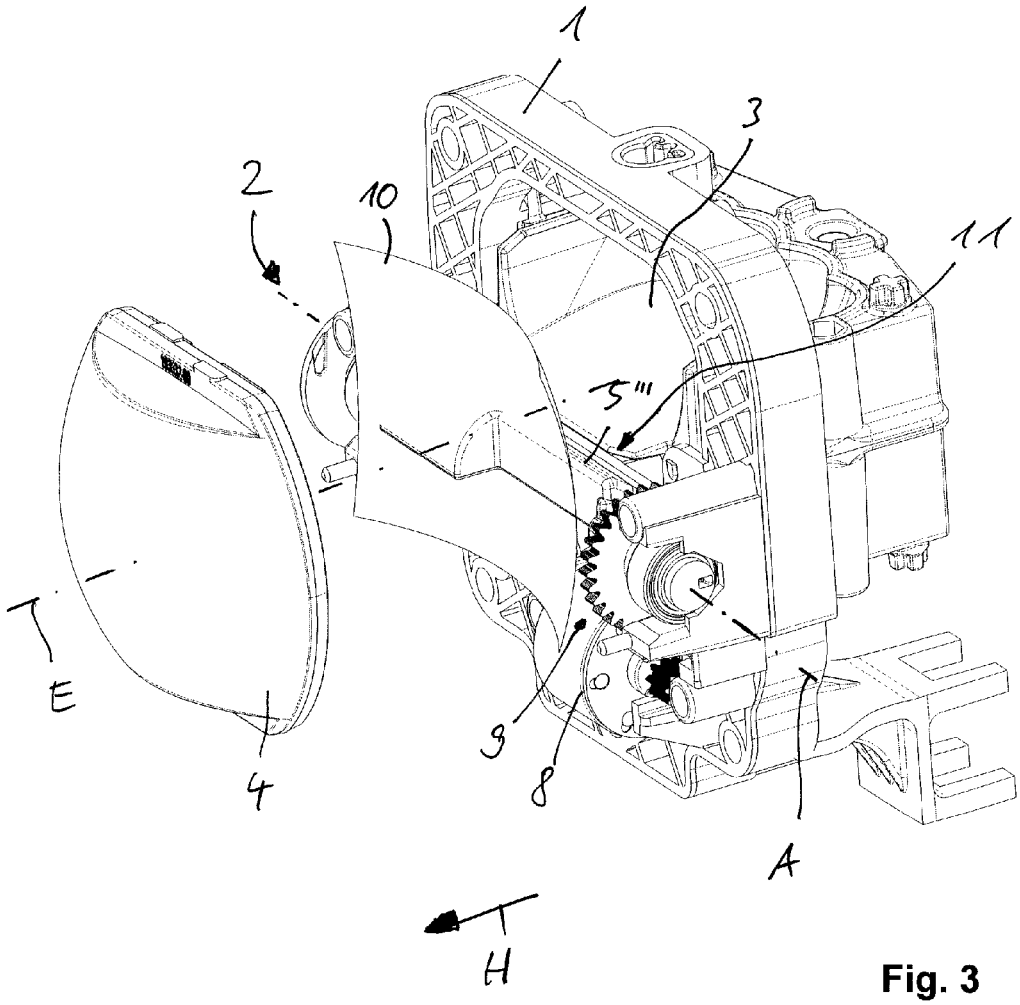
FIG. 3 shows a frontal perspective view of a conventional projection headlight, with the focal plane curvature of the plano-convex lens used in this case included in the drawing.

A conventional headlight for vehicles which works according to the projection principle is illustrated in FIG. 3. It has an upright support frame 1, and an aperture device 2 and a reflector 3 are attached on the same. A light source unit which is not illustrated is functionally assigned to the reflector 3, and is arranged in an internal focal point of the ellipsoidal reflector 3. The aperture device 2 is arranged in front of the reflector 3 in the primary beam direction H, and particularly in a region of a second focal point of the reflector 3. A plano-convex lens 4 is arranged in front of the aperture device 2 in the primary beam direction H, and serves the purpose of projecting an aperture edge 5''' of the aperture device 2 as a light/dark boundary of a city light distribution, for example low beams, high beams, etc.

Figure 2:
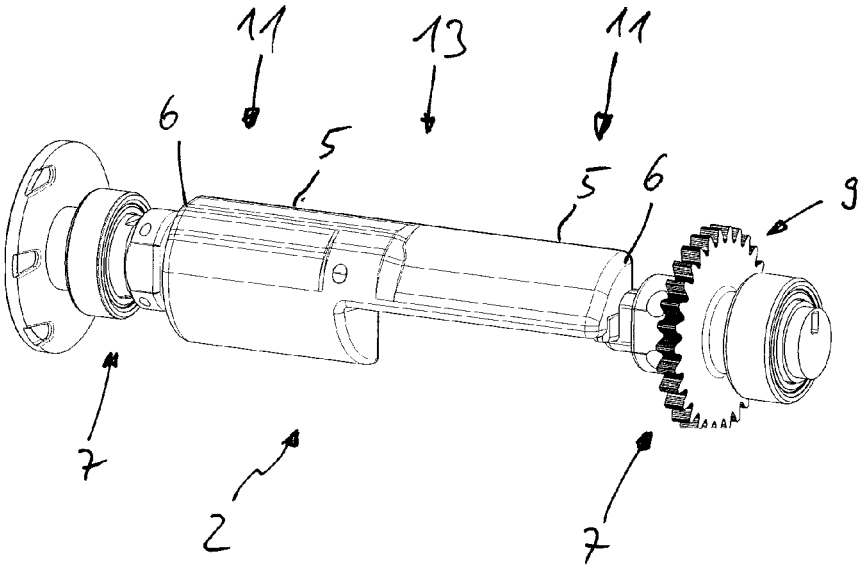
FIG. 2 shows a perspective illustration of a known aperture device, having a straight aperture edge.

The aperture device 2 is designed as an aperture shaft which is mounted about its axis A in a manner allowing rotation, via bearing means 7 connected to opposite ends 6. The aperture shaft 2 has a plurality of aperture edges 5, 5', 5", 5''' on its shell surface, running in the longitudinal direction with respect to the aperture shaft 2, and transverse to an optical axis E. The contours of these aperture edges 5, 5', 5", 5''' generate different light/dark boundaries of the light distribution projected by the lens 4. FIG. 2 shows the aperture shaft 2 in a rotary position in which the straight aperture edge 5 is active as the upper aperture edge, for the purpose of generating a symmetric light distribution, for example a low beam light distribution. If the aperture shaft 2 were rotated such that the aperture edge 5' assumes the upper position, a highway light distribution would be projected by it. In a further illustration in which the aperture edge 5" is active, a backroad light distribution would be generated.

For the purpose of moving the aperture shaft 2 into a prespecified rotary position, the headlight has a drive motor 8 and a gearing 9.

FIG. 3 shows a sketch of the intended curved focal plane 10 of the plano-convex lens 4. It can be seen that only a central region of the aperture shaft 2 runs on or near to the focal plane 10. An end region 11 of the aperture shaft 2 is spaced relatively far from the curved focal plane 10. Ideally, the aperture shaft 2 would need to follow the shape of the curved focal plane 10, such that it would have a banana shape. If the light source unit is only constructed as a point-shaped light source, the optical aberration generated as a result of the curved focal plane of the lens 4 is not functional. The aperture edges 5, 5', 5", 5''' can have a straight profile in the end regions 11 of the aperture shaft 2.

However, if the light source unit is constructed of a plurality of light sources arranged apart from each other spatially—for example LED light sources—such that the light is not emitted from a light point, but rather from an illumination surface, an aperture device 12 having modified aperture edges (15, 15', 15") according to the invention results. These aperture edges (15, 15', 15") have the same contour in a central region 13 of the aperture shaft 12 as the aperture edges 5, 5', 5" of the conventional aperture shaft 2. In contrast to the conventional aperture shaft 2, the aperture shaft 12 according to the invention has a correction edge (16, 16', 16") in each opposite end region 11, which corrects the optical aberration caused by the lens 4 in such a manner that the desired light distribution is generated. If the aperture edge 15 is active, a symmetrical light distribution and/or (low beam light distribution) can be generated. If the aperture edge 15' is active—meaning in an upper rotary position—a highway light distribution is generated. If the aperture edge 15" is in the active position, a backroad light distribution is generated. The light distributions created by the aperture edges (15, 15', 15") with the help of the correction edges (16, 16', 16") substantially correspond to the light distributions generated by the aperture edges 5, 5', 5".

Figure 1:
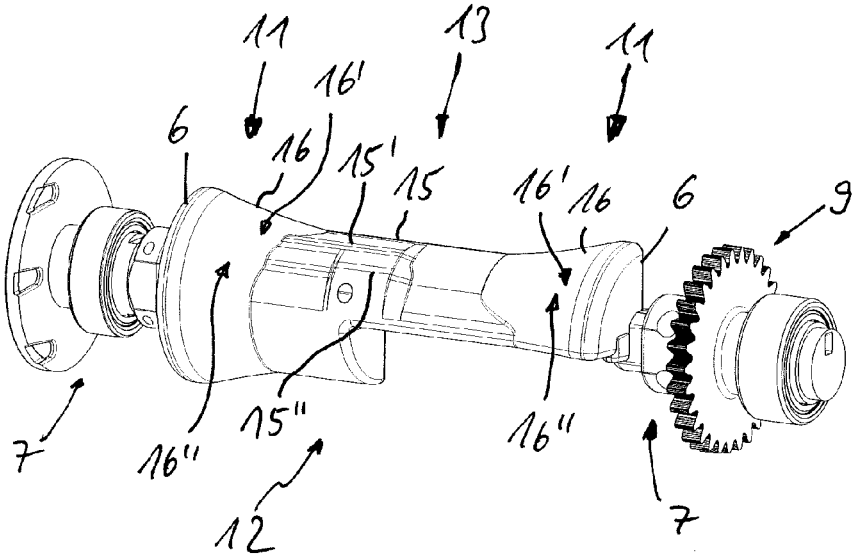
FIG. 1 shows a perspective illustration of an aperture device according to the invention, having correction edges which rise toward one end.

As can be seen in FIG. 1, the aperture shaft 12 has an osteoid shape. The correction edges (16, 16', 16") each continuously rise vertically in the end regions 11 of the aperture shaft 12. The aperture shaft 12 has a conical shape in the end regions 11 of the same.

The light source unit can have a field of light sources which is 1 $m^2$ [sic].

According to one alternative embodiment of the invention which is not illustrated, the lens 4 can also be designed as a concavo-convex lens. To correct the optical aberration, the correction edges of the aperture shaft can likewise have a design with a rise from a central region 13 to the ends 6 of the aperture shaft 12. They merely have a different slope.

According to one alternative embodiment of the invention which is not illustrated, the lens can also have a biconvex shape. In this case, the correction edges do not rise toward the ends 6 of the aperture shaft. Rather, they fall vertically. The aperture shaft therefore narrows towards its ends 6 in the end regions 11 thereof.

According to one alternative embodiment of the invention which is not shown, the aperture device can be constructed with a stationary aperture plate and a rotary aperture plate, wherein the rotary aperture plate can pivot, by means of an actuator element, about an axis of rotation which runs parallel to the optical axis E. According to the rotary position of the rotating aperture plate, an active aperture edge can be formed for the purpose of generating different light distributions. The aperture plates each have corresponding correction edges in their end regions, such that the optical aberration of the lens can be corrected.

Identical components and or component functions of the illustrated headlight are indicated by the same reference numbers.

LIST OF REFERENCE NUMBERS

1 support frame
2 aperture device
3 reflector
4 lens
5, 5', 5" aperture edge
6 ends
7 bearing means
8 drive motor
9 gearing
10 focal surface
11 end region
12 aperture device
13 central region
14
15, 15', 15" aperture edge
16, 16', 16" correction edge H primary beam direction
A axis
E optical axis

The invention claimed is:

1. A headlight for vehicles, comprising:

a reflector, having a light source unit which is functionally assigned to the reflector;

a lens placed in front of the light source unit in a primary beam direction;

an aperture device arranged between the light source unit and the lens, said aperture device being positioned in a focal point region of the lens and having an aperture edge which runs perpendicular to the optical axis for the purpose of generating a light/dark boundary for a prespecified light distribution, wherein the light source unit has a plurality of light sources separated spatially from each other, such that light can be emitted from an illumination surface, and wherein the aperture edge transitions into a correction edge from a central region of the aperture device towards opposite ends of the same, said correction edge running in such a manner that an optical lens aberration resulting from the light source unit being constructed as an illumination surface is compensated.

2. The headlight according to claim 1, wherein the correction edge running in an end region of the aperture edge continuously rises or falls vertically proceeding from the central region of the aperture device, according to the design of the lens.

3. The headlight according to claim 1, wherein the correction edge rises or falls vertically proceeding from the central region to the ends of the aperture device according to the projection scale of the lens and/or the size of the illumination surface and/or the prespecified light distribution.

4. The headlight according claim 1, wherein the lens is designed as a plano-convex or concavo-convex lens, and the correction edge arranged in the end region of the aperture device rises vertically toward the ends of the aperture device.

5. The headlight according claim 1, wherein the lens is designed as a biconcave lens, and the correction edge falls vertically toward the ends of the aperture device.

6. The headlight according claim 1, wherein the aperture device has an aperture shaft which can be set in multiple rotary positions about a horizontal axis of rotation running transverse to the optical axis, and which has a plurality of aperture edges each running in the longitudinal direction of the aperture shaft.

7. The headlight according to claim 6, wherein the aperture shaft has an osteoid design.

8. The headlight according claim 1, wherein the aperture device has a stationary aperture plate, and an aperture plate which is able to rotate about an axis of rotation running parallel to the optical axis, for the purpose of generating different light distributions, wherein aperture edges of the stationary aperture plate and the rotating aperture plate each have correction edges in an end region.

9. The headlight according claim 1, wherein the light source unit extends over a luminous field with a size up to 1 $cm^2$.

10. The headlight according claim 1, wherein the light sources are each designed as LED light sources.

* * * * *